US009161615B2

(12) United States Patent
Nellenbach

(10) Patent No.: US 9,161,615 B2
(45) Date of Patent: Oct. 20, 2015

(54) COLLAPSIBLE PICNIC TABLE SET

(71) Applicant: Bradley Nellenbach, Vernon, NY (US)

(72) Inventor: Bradley Nellenbach, Vernon, NY (US)

( * ) Notice: Subject to any disclaimer, the term of this patent is extended or adjusted under 35 U.S.C. 154(b) by 0 days.

(21) Appl. No.: 14/178,506

(22) Filed: Feb. 12, 2014

(65) Prior Publication Data

US 2014/0225401 A1 Aug. 14, 2014

Related U.S. Application Data

(60) Provisional application No. 61/763,998, filed on Feb. 13, 2013.

(51) Int. Cl.

| | |
|---|---|
| ***A47B 3/08*** | (2006.01) |
| ***A47B 3/091*** | (2006.01) |
| ***A47B 3/14*** | (2006.01) |
| ***A47B 83/02*** | (2006.01) |
| ***A47B 37/04*** | (2006.01) |
| ***A47C 4/04*** | (2006.01) |
| ***A47C 4/10*** | (2006.01) |
| ***A47C 11/00*** | (2006.01) |

(52) U.S. Cl.

CPC . *A47B 3/14* (2013.01); *A47B 37/04* (2013.01); *A47B 83/02* (2013.01); *A47C 4/045* (2013.01); *A47C 4/10* (2013.01); *A47C 11/00* (2013.01)

(58) Field of Classification Search

CPC ..... A47B 83/02; A47B 3/14; A47B 37/04; A47C 4/045; A47C 4/10; A47C 11/00

USPC ..... 297/158.4, 159.1

See application file for complete search history.

(56) References Cited

U.S. PATENT DOCUMENTS

| | | | | |
|---|---|---|---|---|
| 2,583,247 | A * | 1/1952 | Aja et al. | 297/158.4 |
| 3,797,884 | A * | 3/1974 | Gutierrez | 297/158.4 |
| 4,648,652 | A * | 3/1987 | Van Kuren | 297/158.4 |
| 6,109,687 | A * | 8/2000 | Nye et al. | 297/158.4 |
| 6,112,674 | A * | 9/2000 | Stanford | 108/132 |
| 6,431,092 | B1 * | 8/2002 | Stanford | 108/132 |
| 6,530,331 | B2 * | 3/2003 | Stanford | 108/132 |
| 6,905,166 | B2 * | 6/2005 | Zhurong et al. | 297/158.4 |
| 7,051,662 | B2 * | 5/2006 | Shenghao et al. | 108/132 |
| 7,096,799 | B2 * | 8/2006 | Strong et al. | 108/132 |
| 7,278,361 | B2 * | 10/2007 | Zhurong et al. | 108/168 |
| 7,299,754 | B2 * | 11/2007 | Stanford et al. | 108/132 |
| 7,428,872 | B2 * | 9/2008 | Strong et al. | 108/132 |
| 7,475,641 | B2 * | 1/2009 | Jin | 108/132 |
| 7,475,642 | B2 * | 1/2009 | Shenghao et al. | 108/132 |
| 7,640,870 | B2 * | 1/2010 | Strong et al. | 108/132 |
| 7,975,625 | B2 * | 7/2011 | Topham et al. | 108/115 |
| 8,091,490 | B2 * | 1/2012 | Branch et al. | 108/169 |
| 2004/0227382 | A1 * | 11/2004 | Lin | 297/158.4 |

* cited by examiner

*Primary Examiner* — Rodney B White

(74) *Attorney, Agent, or Firm* — The Law Office of Jerry D. Haynes

(57) ABSTRACT

A collapsible picnic table set comprising a tabletop, where the tabletop rests atop a base. The base includes at least two pairs of legs, where each pair of legs includes a support bar; a pivot lock attached beneath the tabletop; and a tension beam attached to the support bar at one end and to the pivot lock at an opposing end. The picnic table includes a pair of collapsible benches, where each of the pair of collapsible benches includes; a seat; at least two pairs of bench legs; at least one support bar connecting the pair of bench legs to each other; a pivot lock fastened beneath the seat; and a bench tension beam attached to the support bar and the pivot lock. The legs of both the picnic table and the benches fold against the tabletop and the seat, respectfully to create a compact structure when not in use.

8 Claims, 3 Drawing Sheets

COLLAPSIBLE PICNIC TABLE SET

CROSS REFERENCE TO OTHER APPLICATIONS

This application claims priority to U.S. Provisional Application Ser. No. 14/944,725 filed on Feb. 13, 2013.

BACKGROUND OF THE INVENTION

1. Field of the Invention

The present invention relates to a picnic table and benches with collapsible legs to allow for easy portability and storage.

2. Description of Related Art

Spring and summer are ideals times of year for outdoor activities especially sports, fairs and picnics. Many parks and amusement centers provide picnic tables that are setup year round to allow for continuous access for families and friends to gather and share snacks and meals. Often at home, picnic tables are used periodically when the family wishes to host a meal outdoors. Because most picnic tables are large, heavy and awkward to move, a family may leave the table outside for the entire spring and summer, and then move it into a storage shed or garage during the cold months. If the picnic table is left out for the season, a large area of the yard is consumed with the table thereby preventing use of that area while the table is out.

As an alternative, some families may opt to set up portable furniture to use temporarily during the short summer months. These pieces are commonly made from plastic or aluminum for easy transport and storage. But since they are made from such a lightweight material, they are often flimsy and unstable. Many times the plastic chairs will crack or break after a few uses, thereby requiring repeated purchases. Also, the aluminum tables are not sturdy enough to support settings for an entire meal, thus limiting their practical use as an eating table.

Therefore, it would be beneficial in the art to provide outdoor dining furniture that is portable for use whenever and wherever needed by a user. It would also be desirable in the art to provide outdoor dining furniture that is portable, compact, lightweight and functional for repeated use.

SUMMARY OF THE INVENTION

In view of the foregoing disadvantages inherent in the prior art, the general purpose of the present invention is to provide a collapsible picnic table with matching chairs, configured to include all of the advantages of the prior art, and to overcome the drawbacks inherent therein.

Accordingly, an object of the present invention is to provide a collapsible picnic table with legs that fold against the tabletop for transport and storage when not in use.

Another object of the present invention is to provide a collapsible picnic table with matching collapsible benches.

Yet another object of the present invention is to provide a collapsible picnic table set that is collapsible with a set of hinges that position the table and bench legs into extended and folded positions.

To achieve the above objects, in an aspect of the present invention, a collapsible picnic table set is described comprising a tabletop, where the tabletop rests atop a base. The base includes at least two pairs of legs, where each pair of legs includes a support bar; a pivot lock attached beneath the tabletop; and a tension beam attached to the support bar at one end and to the pivot lock at an opposing end. The picnic table includes a pair of collapsible benches, where each of the pair of collapsible benches includes; a seat; at least two pairs of bench legs; at least one support bar connecting the pair of bench legs to each other; a pivot lock fastened beneath the seat; and a bench tension beam attached to the support bar and the pivot lock. The legs of both the picnic table and the benches fold against the tabletop and the seat, respectfully to create a compact structure when not in use.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawing and in which:

DETAILED DESCRIPTION OF THE DRAWINGS

The present invention relates to a picnic table and benches with collapsible legs to allow for easy portability and storage. The invention provides a collapsible picnic table with a pair of collapsible benches to update outdoor furnishings thereby making them more convenient for everyday use. The collapsible picnic table and bench include convertible parts, which enable the collapsible picnic table to fold upon itself into a compact design. Once folded, the collapsible table and benches may be simply stored in a garage, storage unit, or even closet until needed again.

Figure 1:
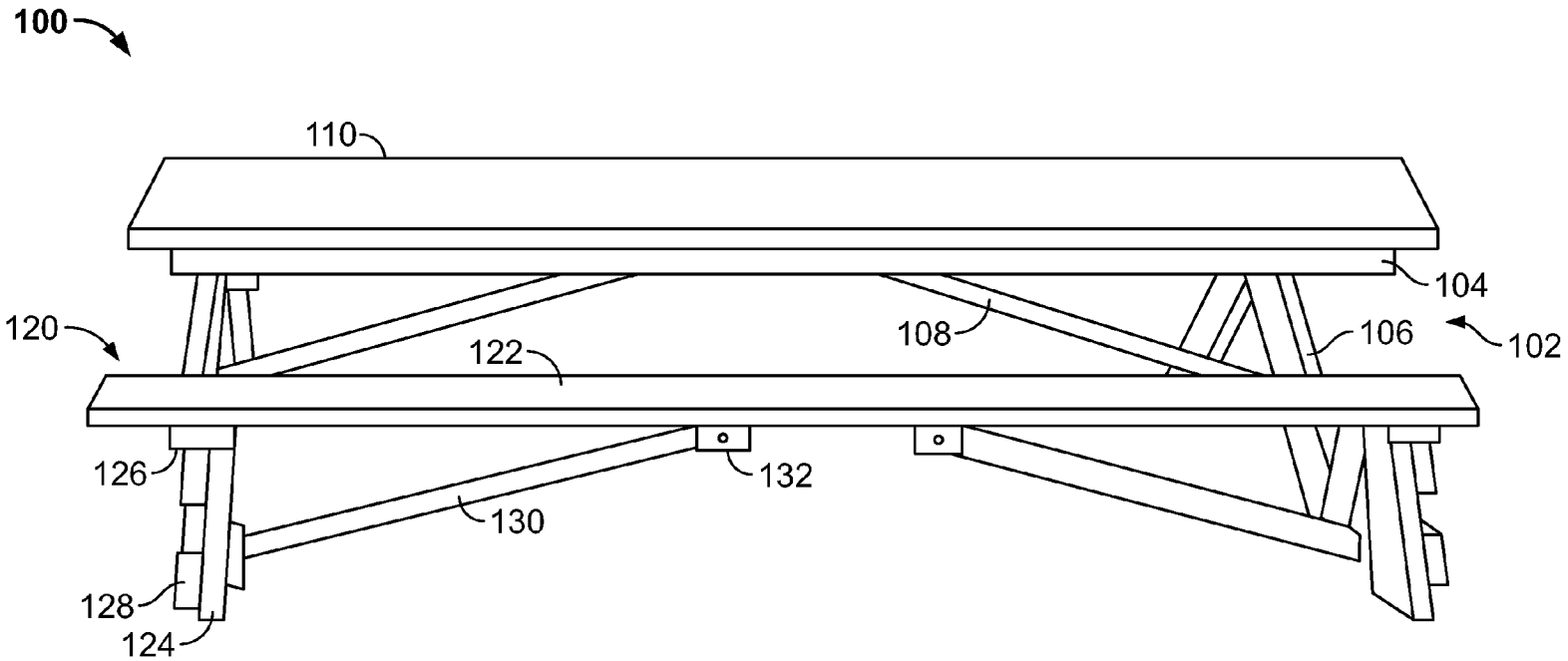
FIG. 1 depicts a side perspective view of a collapsible picnic table and a bench in accordance with an exemplary embodiment of the present invention.

Turning now descriptively to the drawings, FIG. 1 illustrates a side perspective view of a collapsible picnic table 100 and a collapsible bench 120 in accordance with an exemplary embodiment of the present invention. The collapsible picnic table 100 includes a base 102 to support and stabilize a tabletop 110. The base 102 includes a frame 104 attached beneath the tabletop 110, where the frame 104 is positioned around the peripheral edge of the tabletop 110. Extending from the frame 104 are a pair of legs 106 one at each end of the collapsible picnic table 100. The pair of legs 106 lengthen from the tabletop 110 like an inverted V. A tension beam 108 attaches the pair of legs 106 to a pivot lock attached beneath the tabletop 110. The tension beam 108 braces the pair of legs 106 in position to prevent collapsing during use.

The collapsible bench 120 is fashioned similar to the collapsible picnic table 100. The collapsible bench 120 includes an elongated seat 122, which is supported from below with a pair of bench legs 124, one at each end of the collapsible bench 120. The pair of bench legs 124 fastens to the elongated seat 122 at a base bar 126, and is connected to each other with a support bar 128. A bench tension beam 130 extends from the pair of bench legs 124 to a central portion of the seat 122. The bench tension beam 130 attaches beneath the seat 122 at a pivot 132.

Figure 2:
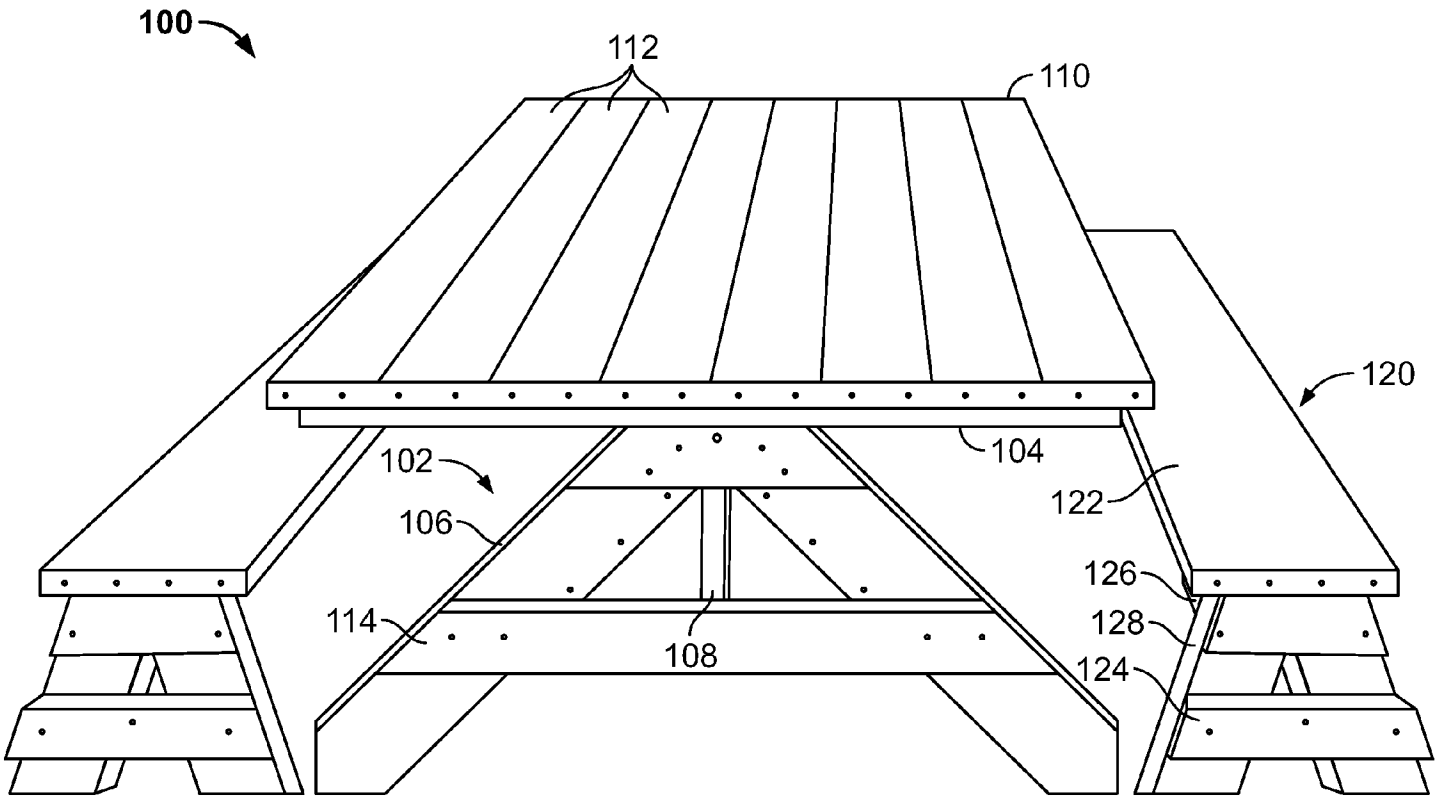
FIG. 2 depicts a front perspective view of a collapsible picnic table and a pair of collapsible benches in accordance with an exemplary embodiment of the present invention.

Referring now to FIG. 2, a front perspective view of the collapsible picnic table pair of collapsible benches 120 are shown in accordance with an exemplary embodiment of the present invention. The tabletop 110 is illustrated with a plurality of slats 112 extending lengthwise atop the base 102. The pair of legs 106 is connected to each other with one or more support bars 114. The lower support bar 114 is attached to the tension beam 108.

Figure 3:
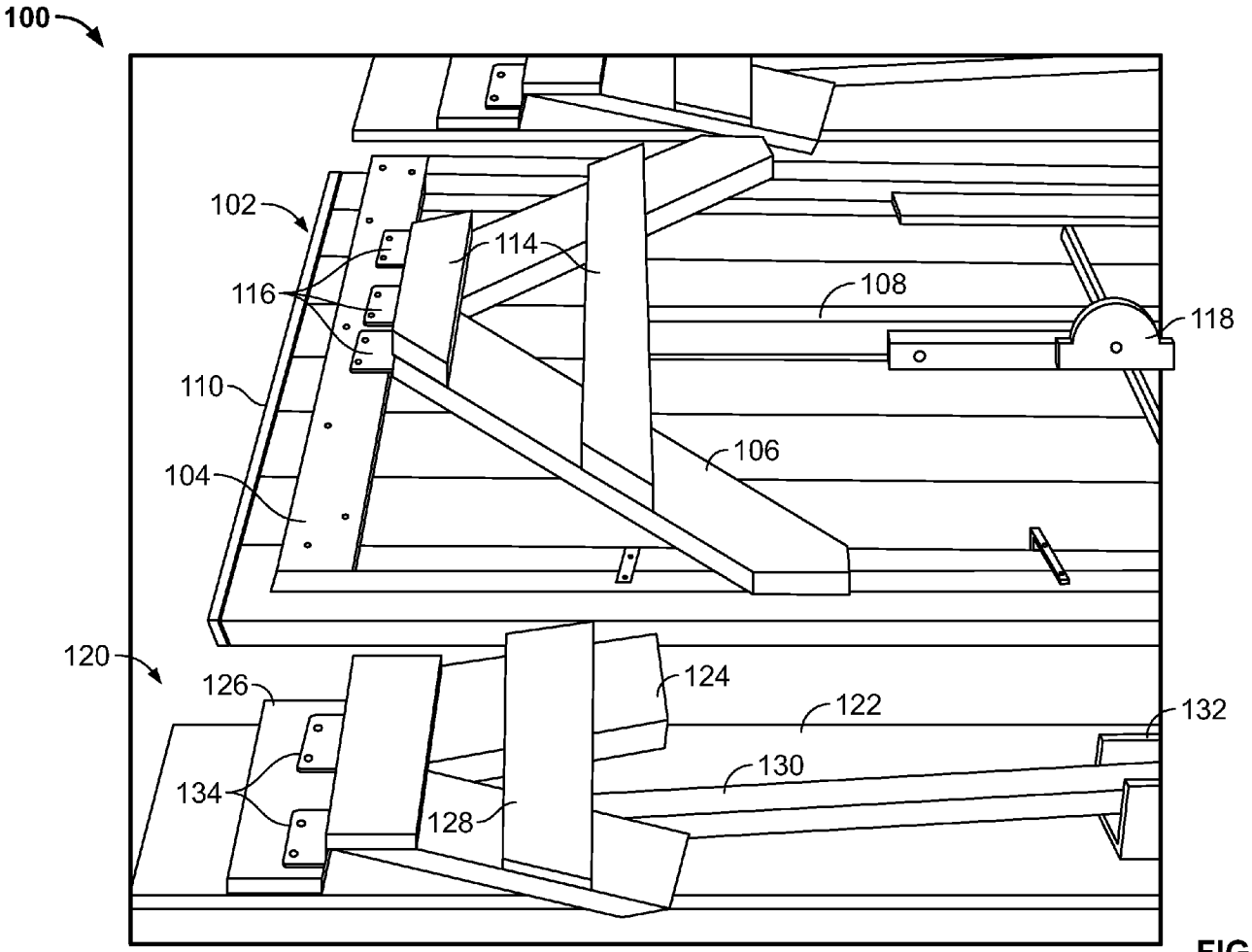
FIG. 3 depicts a perspective view of an underside of a collapsible table and a pair of collapsible benches in a collapsed position in accordance with an exemplary embodiment of the present invention.

Referring now to FIG. 3, a perspective view of an underside of the collapsible picnic table 100 and collapsible benches 120 are illustrated in a folded position in accordance with an exemplary embodiment of the present invention. The frame 104 attaches to the pair of legs 106 with a set of hinges 116. The hinges 116 enable the pair of legs 106 to move from a folded position (as shown) where the pair of legs 106 rest against the tabletop 110 thus parallel to the tabletop, to an extended position where the pair of legs 106 are perpendicular to the tabletop 110. The tension beam 108 is also attached to the support bar 114 with a hinge (not shown). The tension beam 108 of the picnic table 100 is attached to the tabletop 110 with a pivot lock 118.

The pivot lock 118 secures the tension beam 108 against the tabletop 110 when the pair of legs 106 are collapsed or folded. When in the pair of legs 106 are in the extended position the pivot lock 118 maintains the tension beam 108 in a stable position to keep the pair of legs 106 upright.

The bench 120 is constructed like the tabletop 110 and base 102. The pair of bench legs 124 attach to the base bar 126 with a set of hinges 134. Likewise, the bench tension beam 130 is attached to the lower support bar 128 at one end and then a pivot lock 132 at an opposing end. The pivot lock 132 enables the bench tension beam 130 to collapse against the seat 122 when the pair of bench legs 124 folds again the seat 122. Alternatively, the pivot lock 132 secures the bench tension beam 130 against the support bar 128 when the pair of bench legs 124 is perpendicular to the seat 122.

The collapsible picnic table 110 and benches 120 may be made from wood, preferably pine wood panels. Alternatively, the picnic table 110 and benches 120 may be made from a synthetic material like plastic, aluminum, fiberglass, polyethylene or the like. A synthetic material may allow for a more lightweight structure than using wood, therefore providing greater portability. The dimensions of the picnic table 100 may range from 3-5 feet in width, preferably 4 feet, 6-10 feet in length, preferably 8 feet, and 2½ feet tall. The bench 120 may range in length to coordinate with the picnic table 100; the width may range from 10-12 inches, preferably 11 inches, and 17 inches in height. When in the folded position the picnic table 100 and benches 120 may stand approximately 7 inches in height depending on the width of each material used.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A collapsible picnic table set comprising:

a. a tabletop resting atop the picnic table, where the tabletop includes a plurality of slats extending lengthwise atop the base;

b. a base positioned beneath the tabletop, where the base includes:

i. at least two pairs of legs, where a pair of legs is positioned beneath each end of the tabletop;

ii. at least one support bar connecting the pair of legs to each other;

iii. a pivot lock attached beneath the tabletop;

iv. a frame attached beneath a peripheral edge of the tabletop, and where the pair of legs extends from the frame, one pair at each end of the tabletop, wherein the pair of legs is attached to the frame with a set of hinges, where the set of hinges enable the pair of legs to move into a folded position, where when in the folded position the pair of legs abut the underside of the tabletop; and v. a tension beam attached to the support bar at one end and to the pivot lock at an opposing end, wherein the pivot lock of the picnic table secures the tabletop to the tension beam of the base; and c. a pair of collapsible benches, where each of the pair of collapsible benches includes;

i. a seat;

ii. at least two pairs of bench legs, a pair of legs at each end of the seat, where the pair of legs is shaped like an inverted-V:

iii. at least one support bar connecting the pair of bench legs to each other;

iv. a pivot lock fastened beneath the seat, where the pivot lock of the bench secures the seat to the tension beam of the bench; and v. a bench tension beam attached to the support bar and the pivot lock.

2. The collapsible picnic table set according to claim 1, where the bench includes a base bar, where the pair of bench legs extends from the base bar.

3. The collapsible picnic table set according to claim 2, where the pair of bench legs is attached to the base bar with a set of hinges.

4. The collapsible picnic table set according to claim 3, where the set of hinges enable the pair of bench legs to fold against the seat.

5. The collapsible picnic table set according to claim 1, where the tension beams of each the base and the bench attaches to the support bar with a hinge.

6. The collapsible picnic table set according to claim 1, where the seat is elongated to create a bench as long as the tabletop.

7. The collapsible picnic table set according to claim 1, where the collapsible picnic table is made from wood.

8. The collapsible picnic table set according to claim 1, where the collapsible picnic table is made from one of at least plastic, aluminum, fiberglass or polyethylene.

* * * * *